US005158069A

United States Patent [19]

Hamos

[11] Patent Number: 5,158,069

[45] Date of Patent: Oct. 27, 1992

[54] WIND-RESISTANT HEATING APPLIANCE

[75] Inventor: Robert E. Hamos, Simi Valley, Calif.

[73] Assignee: Teledyne Industries, Inc., Los Angeles, Calif.

[21] Appl. No.: 807,207

[22] Filed: Dec. 16, 1991

[51] Int. Cl.[5] ..... F23I 11/00

[52] U.S. Cl. ..... 126/350 R; 126/85 A; 126/307 A; 122/235.14; 122/367.3

[58] Field of Search ..... 126/350 R, 361, 360, 126/364, 344, 389, 373, 307 R, 307 A, 85 R, 85 B; 122/367.1, 235.17, 367.3, 406, 264, DIG. 13; 165/177, 172, 185, 173, 109.1, 184, 175; 237/8 C

[56] References Cited

U.S. PATENT DOCUMENTS

| | | | |
|---|---|---|---|
| 2,651,299 | 9/1953 | Brown, Jr. | 126/85 R |
| 2,811,095 | 10/1957 | Moran | 126/85 R |
| 3,082,758 | 3/1963 | Heiman | 126/110 R |
| 3,421,482 | 1/1969 | Ortega | 122/264 |
| 3,504,661 | 4/1970 | Morris et al. | 126/85 B |
| 3,536,060 | 10/1970 | Block | 126/307 R |
| 3,623,458 | 11/1971 | Block | 122/264 |
| 3,797,477 | 3/1974 | Ramey | 126/307 A |
| 3,800,748 | 4/1974 | Schindler et al. | 126/307 A |
| 3,824,986 | 7/1974 | Ramey | 126/360 R |
| 3,874,363 | 4/1975 | Biedenbender et al. | 126/85 B |
| 4,461,273 | 7/1984 | Barker et al. | 126/77 |
| 4,501,232 | 2/1985 | Gordbegli et al. | 126/350 R |
| 4,580,548 | 4/1986 | Ono | 126/307 A |
| 4,679,545 | 7/1987 | Cavestany | 126/350 R |
| 4,751,897 | 6/1988 | Malhere et al. | 126/350 R |
| 4,893,609 | 1/1990 | Giordani et al. | 126/350 R |

*Primary Examiner*—James C. Yeung
*Attorney, Agent, or Firm*—Benoit Law Corporation

[57] ABSTRACT

A wind-resistant heating appliance has a housing with air inlet openings for sustaining combustion generating flue products inside that housing which also has an outlet for flue products. The heating appliance has a top structure above that outlet and the housing. A top wall of that top structure is penetrated with exhaust openings for flue products along opposite edges of that top structure. The outlet between the housing and the top structure is provided with a transverse outlet channel inside the top structure and has opposite ends open at the exhaust openings adjacent the opposite edges of the top structure. That transverse outlet channel is solidly enclosed along its top, sides and bottom between the opposite ends, except for the outlet between the housing and the top structure. The exhaustion of flue products in various wind conditions is further aided by increasing the speed of flue products passing through the outlet from the housing to the transverse outlet channel. Where such speed increase is effected by a flue product collector diminishing in cross-section from the housing to the transverse outlet channel, that diminishing cross-section for exhausting flue products conversely presents an increasing cross-section for downdrafts, which diminishes their impact on the heater operation.

15 Claims, 5 Drawing Sheets

WIND-RESISTANT HEATING APPLIANCE

FIELD OF THE INVENTION

The subject invention relates to heaters and heating systems and, more specifically, to pool and spa heaters and other heating appliances generating flue products, and to methods and apparatus for rendering such appliances wind resistant.

SUMMARY OF THE INVENTION

It is an object of the invention to provide improved heaters and heating systems.

It is germane object of the invention to provide improved pool and spa heaters and other heating appliances emitting flue products.

It is a related object of the invention to provide methods and apparatus for rendering the operation of flue-product-generating heating appliances wind resistant.

It is also an object of the invention to provide improved baffles for heat exchangers.

Other objects of the invention will become apparent in the further course of this disclosure.

The invention resides in a method of providing and operating an outdoor heating appliance wherein internal flames produce flue products inside a housing of the heating appliance. The invention resides more specifically in the improvement of rendering the operation of the heating appliance wind resistant, comprising in combination the steps of penetrating the housing with air inlet openings for sustaining combustion generating the flue products inside the heating appliance, providing the housing with an outlet for the flue products, providing the heating appliance above that outlet and the housing with a top structure having a top wall, penetrating that top wall with exhaust openings for the flue products along opposite edges of the top structure, providing the outlet between the housing and the top structure with a transverse outlet channel inside that top structure having opposite ends open at the exhaust openings adjacent the opposite edges of the top structure, solidly enclosing the transverse outlet channel along its top, sides and bottom between the opposite ends, except for the outlet between the housing and the top structure, providing the top structure with solid wall portions between the exhaust openings and the outlet openings and adjacent the opposite ends of the transverse outlet channel, and increasing the speed of flue products passing through said outlet from the housing to the transverse outlet channel.

The invention resides correspondingly in an outdoor heating appliance wherein internal flames produce flue products inside a housing of that heating appliance, and resides, more specifically, in the improvement of rendering the operation of the heating appliance wind resistant, comprising in combination, inlet openings in the housing for air sustaining combustion generating the flue products inside the heating appliance, a flue product outlet in the housing, a heating appliance top structure having a top wall above the outlet and the housing, exhaust openings for the flue products penetrating the top wall along opposite edges of the top structure, a transverse outlet channel for the outlet between the housing and the top structure; that transverse outlet channel being inside that top structure and having opposite ends open at the exhaust openings adjacent the opposite edges of the top structure, and a flue product collector encompassing the outlet and depending from the transverse outlet channel into the housing and diminishing in cross-section from the housing to the transverse outlet channel; the transverse outlet channel solidly enclosed along its top, sides and bottom between the opposite ends except for the flue product collector between the housing and the transverse outlet channel, and that top structure having solid wall portions between the exhaust openings and the outlet openings and adjacent the opposite ends of the transverse outlet channel.

The invention resides also in a method of providing a baffle for an adjacent pair of elongate finned tubes of a heat exchanger, wherein each of said tubes has an annular heat-exchange fin structure thereabout, comprising in combination the steps of providing the baffle with two elongate sections at an obtuse angle for accommodating one of the heat-exchange fin structures, and providing the baffle with a third elongate section at an acute angle to one of the two elongate sections for accommodating the heat-exchange fin structures of both of said pair of elongate finned tubes at that acute angle.

The invention resides correspondingly in a heat exchanger including a baffle for an adjacent pair of elongate finned tubes of the heat exchanger, wherein each of these tubes has an annular heat-exchange fin structure thereabout, comprising in combination, two elongate sections extending at an obtuse angle to each other so as to accommodate one of the heat-exchange fin structures, and a third elongate section extending at an acute angle to one of the two elongate sections so as to accommodate the heat-exchange fin structures of both of said pair of elongate finned tubes.

BRIEF DESCRIPTION OF THE DRAWINGS

The subject invention and its various aspects and objects will become more readily apparent from the following detailed description of preferred embodiments thereof, illustrated by way of example in the accompanying drawings, in which like reference numerals designate like or equivalent parts, and in which:

FIG. 6 is a side view, partially in section and on an enlarged scale, of representative parts of a heat exchanger that may be used in the heating appliances of FIGS. 1 to 5, for instance.

DESCRIPTION OF PREFERRED EMBODIMENTS

Figure 1B:
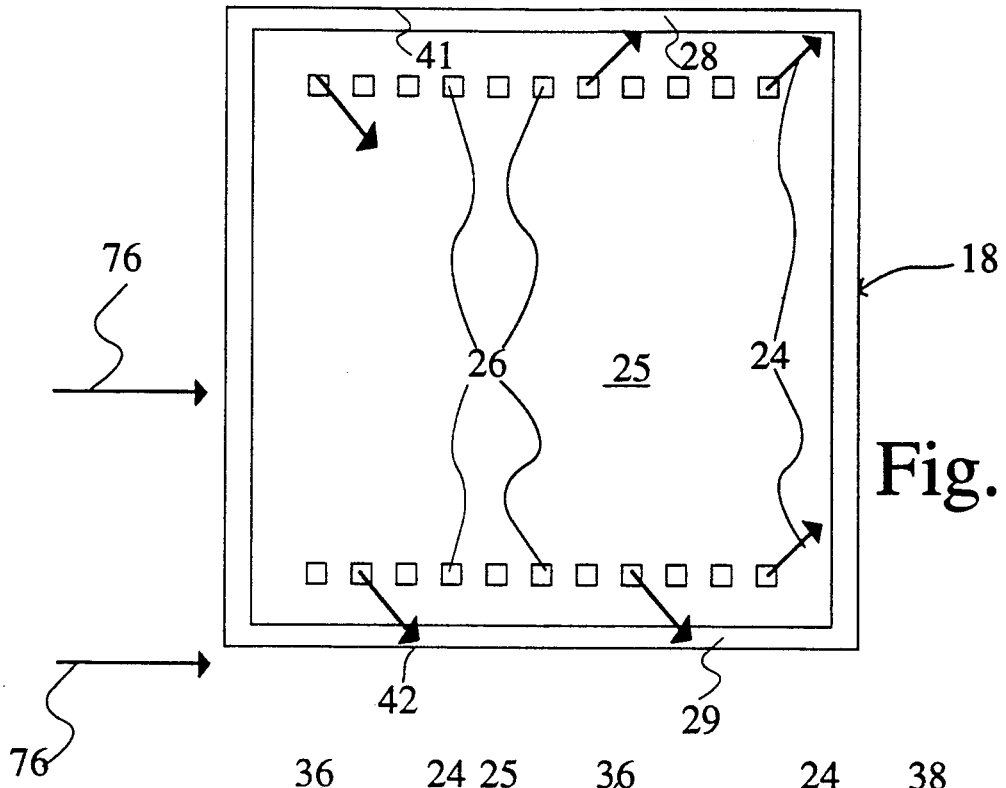
FIG. 1*a* is a side view in section and FIB. 1*b* is a top view thereabove of a wind-resistant heating appliance according to a preferred embodiment of the subject invention.
Figure 1A:
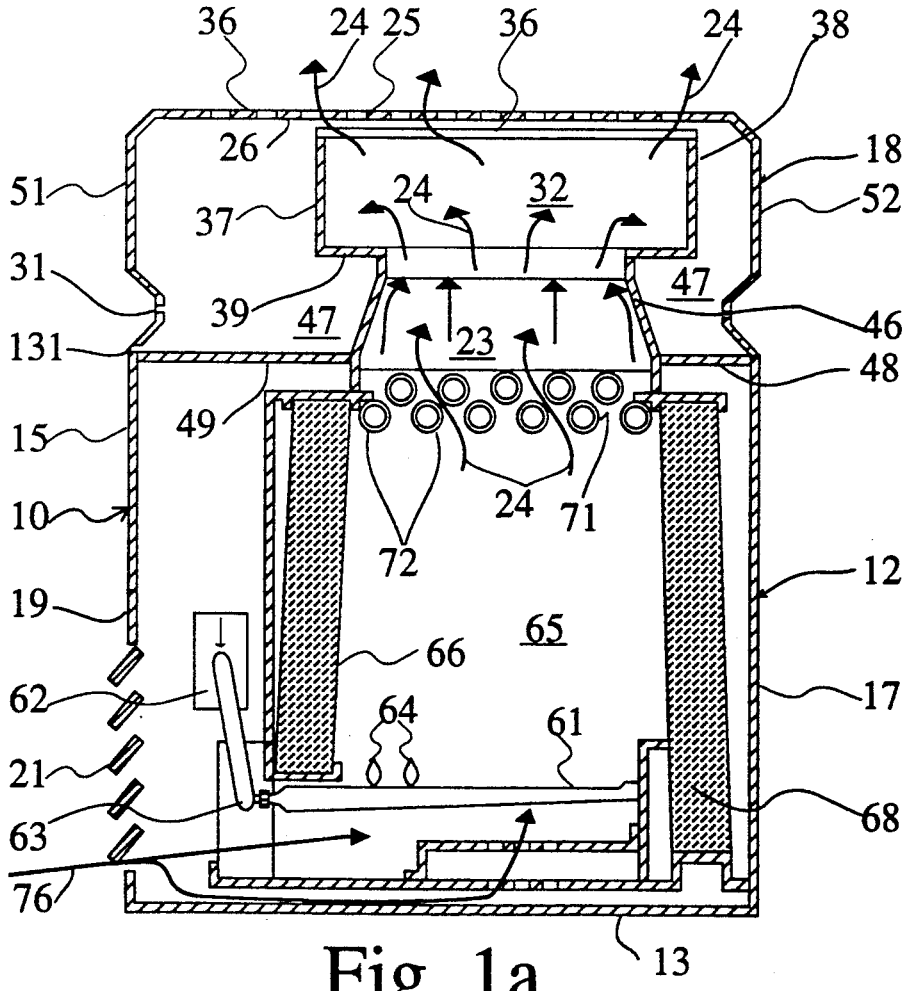
Figure 2B:
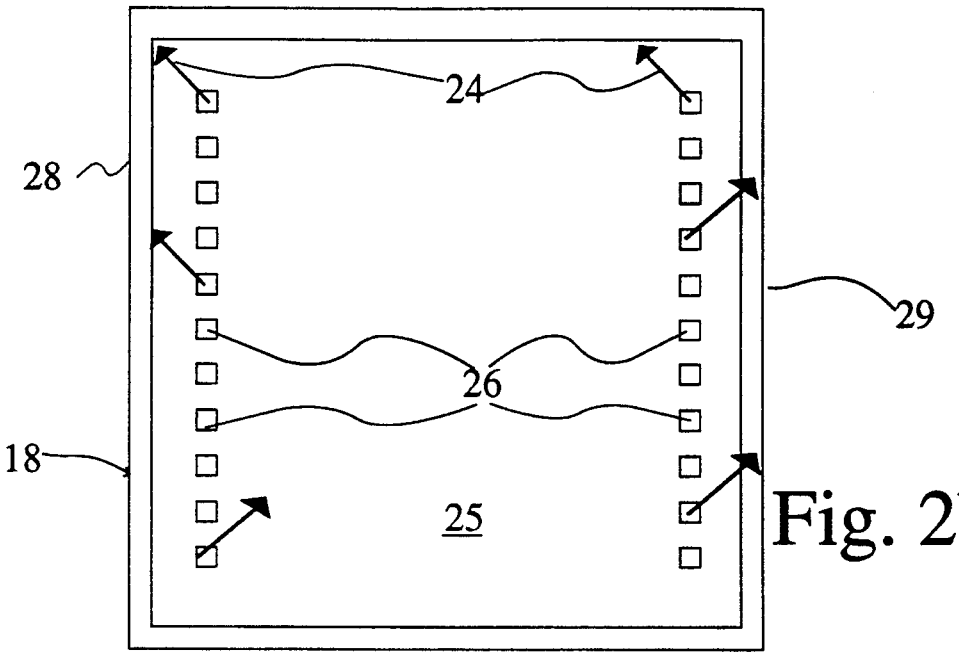
FIG. 2*b* is corresponding top view of the heating appliance of FIG. 1.
Figure 2A:
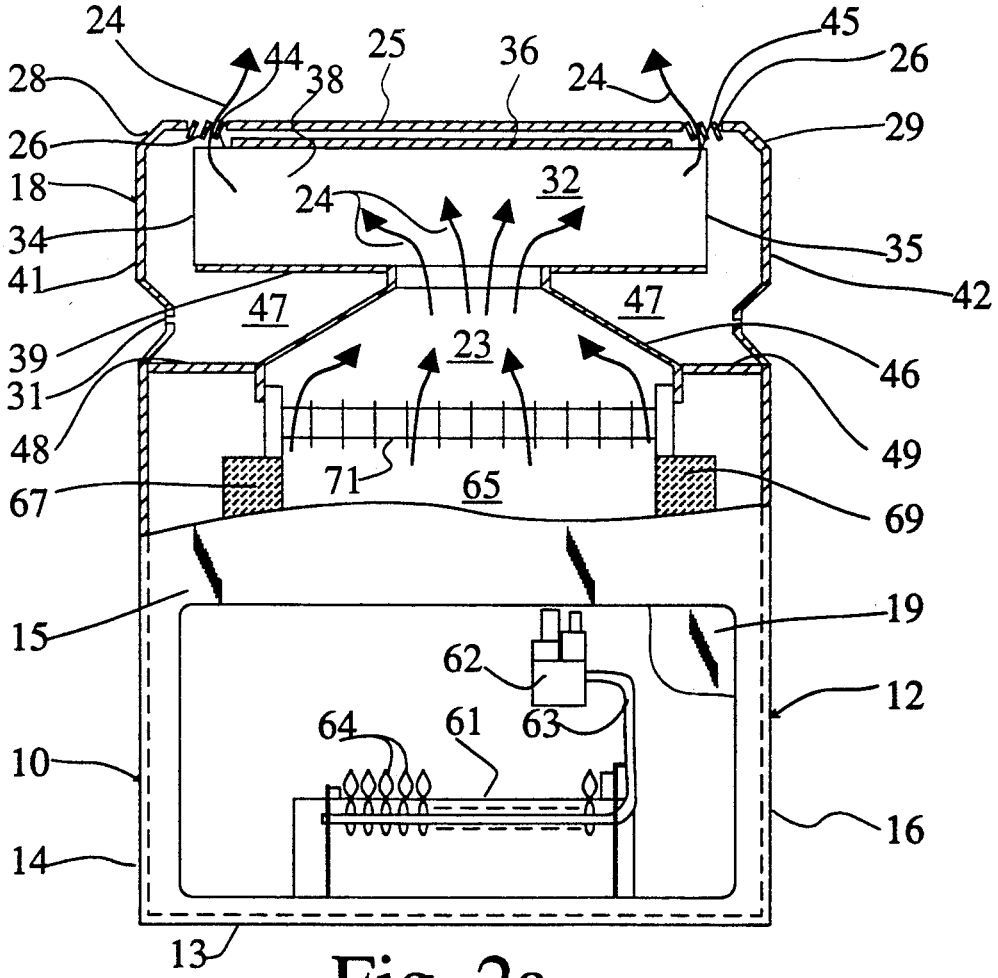
FIG. 2*a* is a front view, partially in section.

The heating appliance 10 includes a housing 12 having in the preferred embodiment shown in the drawings a closed bottom 13 and four side walls 14, 15, 16 and 17 below a top structure 18. The side walls 14, 16 and 17 are preferably closed. In this respect, two of these walls may be designated as front wall 15 and rear wall 17, respectively, and part of the front wall may be formed by a panel or door 19 that is removable for access to internal parts of the heating appliance, and that preferably has louvers or openings 21 for the flow of operating air into the heating appliance 10, sustaining the combustion of gas or other fuel therein which generates flue products within the heating appliance. The invention provides the housing 12 with an outlet 23 for the flue products 24, and provides the heating appliance above that outlet and that housing with the top structure 18 having a top wall 25. That top wall is penetrated with exhaust openings 26 for the flue products along opposite edges 28 and 29 of the top structure 18. There may be one or more rows of exhaust openings along each of these edges.

The appliance is substantially closed between the housing 12 and the top structure 18 below the exhaust openings 26, except for a crack 31 and possibly one or more rain water drain apertures 131. If desired, the floor or sheets 48 and 49 may be raised to the level of the crack 31 so that rain water and condensation may escape therethrough.

The invention further provides the outlet 23 between the housing 12 and the top structure with a transverse outlet channel 32 inside that top structure 18. Such outlet channel has opposite ends 34 and 35 open at the exhaust openings 26 adjacent the opposite edges 28 and 29 of the top structure 18, and at the crack 31 for that matter.

The illustrated preferred embodiment solidly encloses the transverse outlet channel 32 along its top 36, sides 37 and 38 and bottom 39 between the opposite open ends 34 and 35, except for the outlet 23 between the housing 12 and the top structure 18.

The invention also provides the top structure 18 with solid wall portions 41 and 42 between the exhaust openings 26 and the crack 31 and adjacent the opposite open ends 34 and 35 of the transverse outlet channel 32.

The subject invention increases the speed of flue products 24 passing through the outlet 23 from the housing 12 to the transverse outlet channel 32. In this respect, a preferred embodiment of the invention encompasses the outlet 23 with a flue product collector 46 depending the said transverse outlet channel 32 into the housing 12 and diminishing in cross-section to increase the speed of flue products 24 passing through that flue product collector from that housing to the transverse outlet channel.

This speed or velocity increase of the flue products aids the exhaust of these flue products 24 from the appliance 10 despite various wind conditions. This prevents the dreaded "stuffing" of flue products in the heater, which used to be responsible for generation of carbon monoxide and other effects of incomplete combustion.

There also is around the outlet 23 a space 47 diminishing in cross-section toward the heater housing 12 and increasing in cross-section toward the transverse outlet structure 32.

The subject invention thus renders the operation of the heating appliance 10 wind resistant. In structural terms, an outdoor heating appliance according to the invention has inlet openings in the housing 12 for air sustaining combustion generating flue products 24 inside the heating appliance, such as the inlet openings 21 in the door 19, a flue product outlet 23 in the housing 12, and a heating appliance top structure 18 having a top wall 25 above that outlet 23 and housing 12.

Exhaust openings 26 for the flue products penetrate the top wall 25 along opposite edges 28 and 29 of the top structure. A transverse outlet channel 32 for the outlet 23 between the housing 12 and the top structure is inside that top structure 18 and has opposite ends 34 and 35 open at the exhaust openings 26 adjacent the opposite edges 28 and 29 of the top structure. A flue product collector encompasses the outlet and depends from the transverse outlet channel 32 into the housing 12 and diminishes in cross-section from that housing the transverse outlet channel. That transverse outlet channel 32 is solidly enclosed along its top 36, sides 37 and 38 and bottom 39 between the opposite ends 34 and 35 except for the outlet 23 or flue product collector 46 between the housing 12 and the top structure 18. The top structure 18 further has solid wall portions 41 and 42 between the exhaust openings 26 and the outlet openings 31 and adjacent the opposite open ends 34 and 35 of the transverse outlet channel 32.

In this manner, the invention protects the heating appliance and thereby its function against all kinds of wind conditions, such as those shown in FIGS. 1*a*, 1*b*, 2*a*, 2*b*, 3*a*, 3*b*, 4*a*, and 4*b*, respectively, as more fully described below.

The drawings more specifically illustrate components of the heater top according to a preferred embodiment of the subject invention.

In particular, according to an embodiment of the invention, the top 36 of the transverse outlet channel is recessed or has recesses 44 and 45 for better performance in various wind conditions. These recesses 44 and 45 are provided below the exhaust openings 26 relative to the bottom 39 of that transverse outlet channel 32 at the opposite ends 34 and 35. In preferred apparatus, the exhaust openings 44 and 45 are moved inwardly from the edges 28 and 29 to above the recesses 44 and 45.

For better performance in various wind conditions, the housing 12 preferably is closed off below the top structure 18 on top of the housing. Sheets 48 and 49 may be employed for this purpose in conjunction with the collector 46.

In the illustrated preferred embodiment, the top structure also has closed or solid walls 51 and 52, whereby that top structure 18 is closed all around by four solid walls 41, 42, 51 and 52.

The subject invention is not limited in scope to a particular type of heating appliance. However, the drawings show the heating appliance 10 as having a gas burner 61 mounted in a lower part thereof. The burner is supplied with combustible gas through a control valve and pipe assembly 62 and 63. Upon ignition, the burner provides gas flames 64 generating heat in the heater chamber 65, which may at least partially be defined by walls 66, 67, 68 and 69 of refractory material. By way of example, that heat may be employed for heating another medium, such as air, water, oil, etc. Heating appliances according to the subject invention may thus be employed for various purposes. However, the illustrated preferred embodiments of the invention are more specifically concerned with an outdoor heating appliance, that may or may not be converted to an indoor heating appliance. Flue products are reliably exhausted no matter from what direction the wind is coming.

A prototype of the illustrated embodiment has been designed as a swimming pool or spa heater, which currently is the best mode contemplated for carrying out the subject invention. Accordingly, pipes of a heat exchanger 71 are shown in the upper part of the appliance or fire chamber 65. In the operation of the heating appliance, internal flames 64 produce flue products 24 which heat the water 72 in the heat exchanger 71 and which are exhausted through top openings 26 and/or outlets 31 as described above, and as still more fully described below.

In this respect, FIGS. 1*a*, 1*b*, 2*a* and 2*b* illustrate a normal operation of the appliance in little or no wind, where the flue products travel through the central or internal housing opening 23 and transversely along the outlet channel 32 bilaterally through its outlet openings 34 and 35 and hence through exhaust openings 26 to atmosphere. In that case, air from below the top structure may enter the openings 31 between the housing 10 and that top structure 18 and may aid the exhaust of flue products, thereby leaving the exhaust openings 26 with those flue products 24.

Figure 3B:
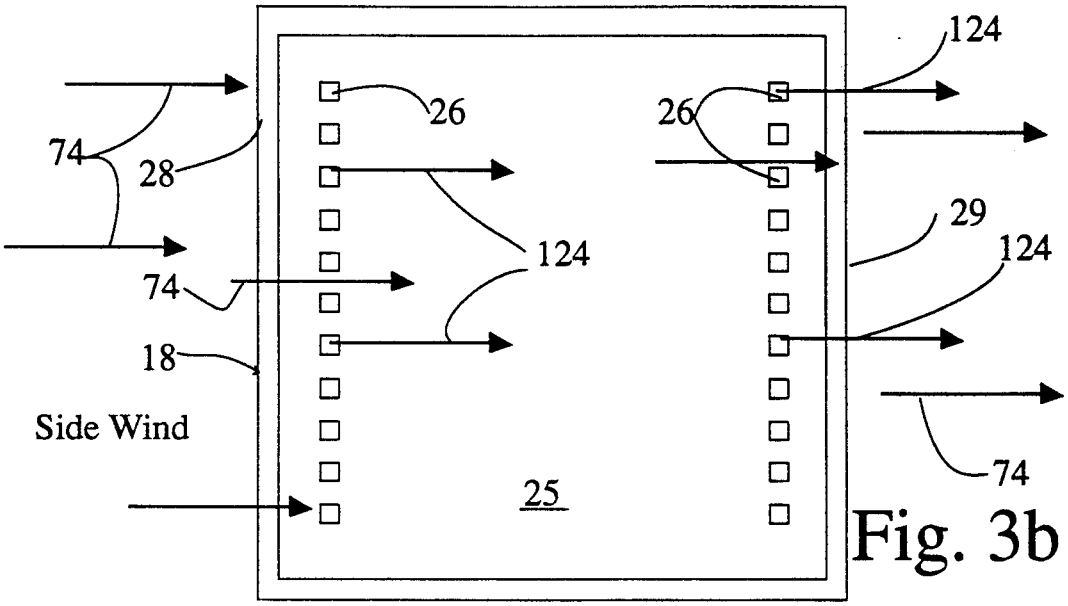
FIGS. 3*a* and 3*b* are views similar to FIGS. 2*a* and 2*b* illustrating operation in a side wind condition.
Figure 3A:
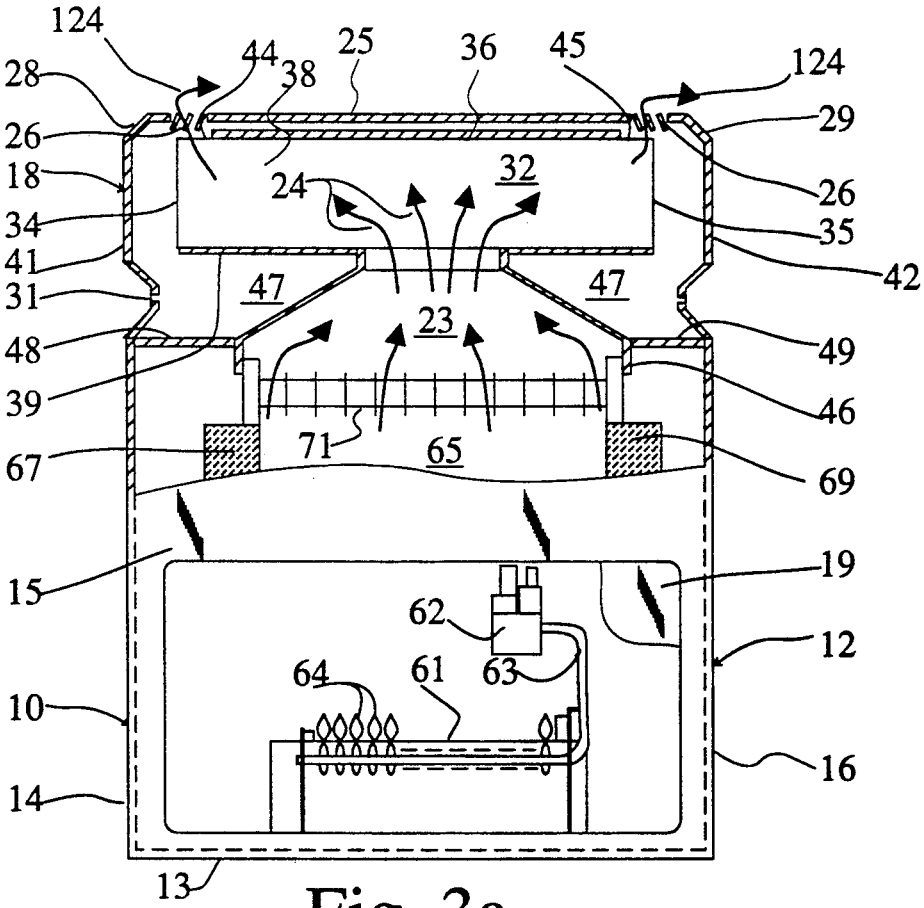

By contrast, FIGS. 3*a* and 3*b* illustrate a situation in which a side wind 74 impinges upon the heating appliance. As indicated by arrows 124, flue products are reliably driven out of the exhaust openings 26 by the side winds 74.

The same applies in the case of front or rear winds, which may be considered side winds for such purposes.

In the case of a front wind 76 against the front wall 15, air entering the front door louvers 21 not only contributes oxygen or air of combustion to the burner 61 or flames 64, but also aids in the exhaustion of flue products, in proportion to wind velocity or strength. Preferably, such winds not only aid in the exhaustion of flue products by establishing a negative or lower pressure above the exhaust openings 26, but also by establishing a positive or higher pressure in the burner chamber 65.

In a freestanding outdoor appliance, winds may also proceed toward the rear wall 17 of the appliance. In that case, winds would again establish a negative or lower air pressure in the region above the top surface 25 for exhausting flue products 26 through top openings 26. If air supply in the case of winds from the rear should be a problem, louvers or other air inlets similar to the air inlets or louvers 21 may be provided in the rear wall 17.

Figure 4B:
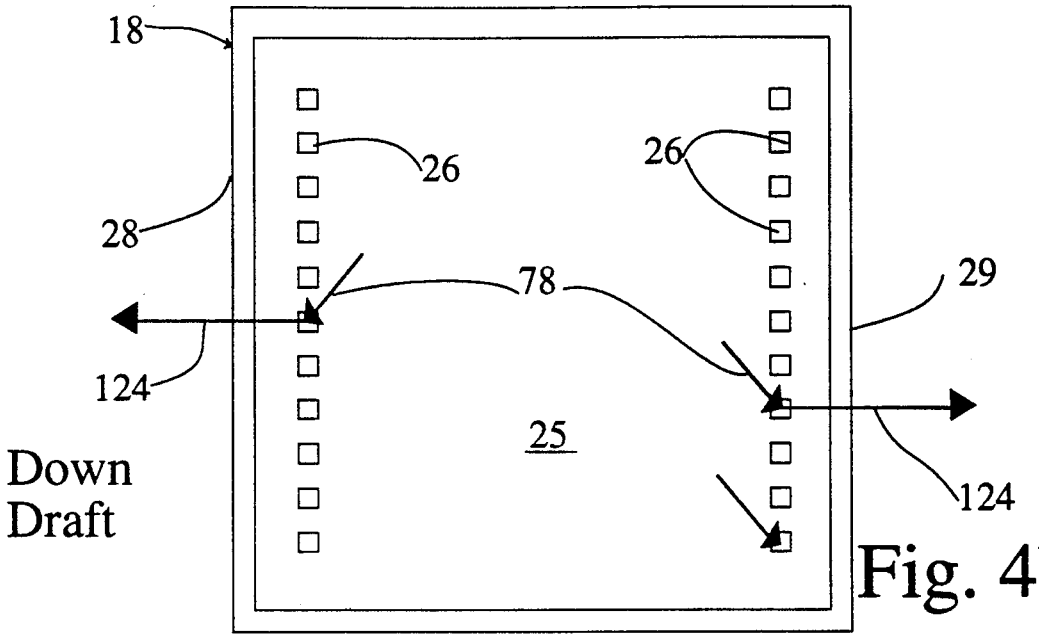
FIGS. 4*a* and 4*b* are views similar to FIGS. 2*a* and 2*b* illustrating operation in a down draft condition.
Figure 4A:
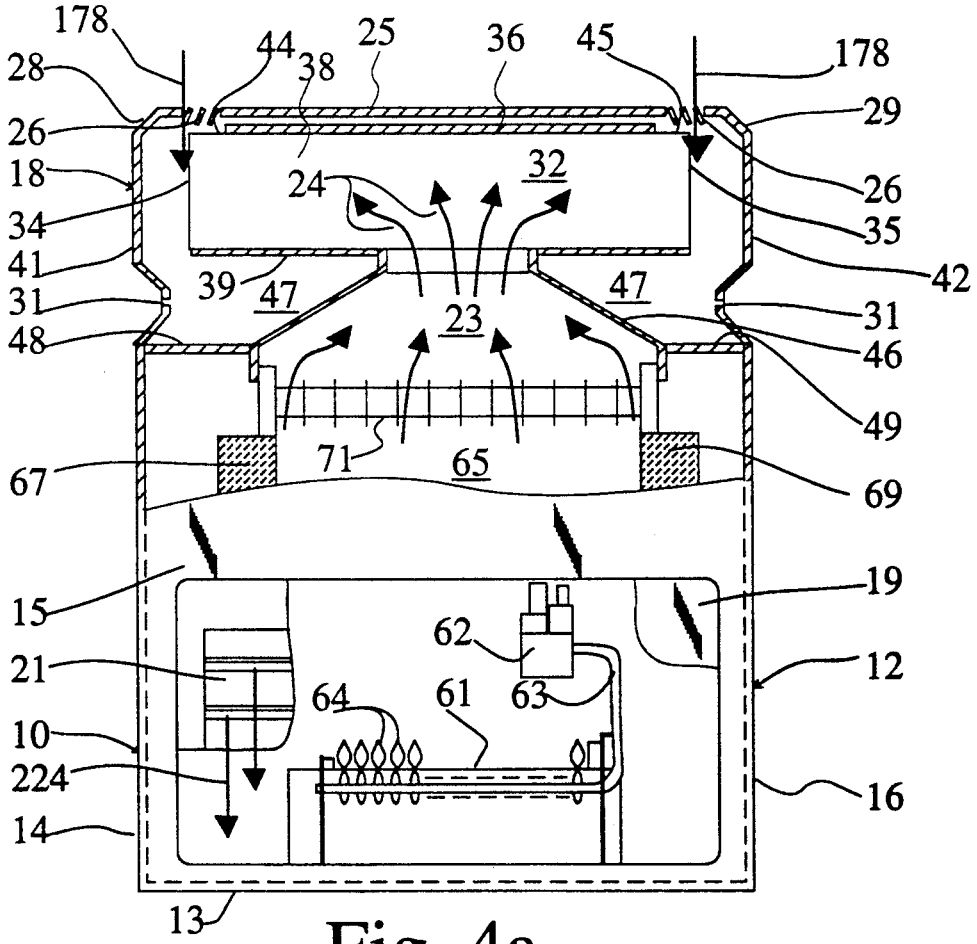

The views of FIGS. 4*a* and 4*b* illustrate how the illustrated embodiment successfully handles gusts of wind occurring as downdrafts.

In this respect, drafts 78 that sweep downward at an acute angle to the top wall 25, as indicated in the top view of FIG. 4*b*, produce a component that sweeps flue products 124 out of the exhaust openings 26 in a manner similar to what has been described above in the case of side winds illustrated in FIGS. 3*a* and 3*b*. However, a vertical component or vertical downdraft 178 can enter the top openings 26 and produce a corresponding exhaust 224 through the louvers 21 serving otherwise as air inlet openings, such as in the door 19. Such downdraft components are short gusts that have not been able to blow out the flames 64 in the illustrated appliance. Where the cross-section of the flue collector 46 diminishes toward the outlet channel 32 to increase the velocity and thereby the exhaustion of flue products 24, it conversely increases from such outlet channel 32 toward the heater chamber 65, thereby diminishing the velocity and thereby the impact of downdrafts 178 on the heater operation. Accordingly, where such speed increase is effected by a flue product collector diminishing in cross-section from the housing to the transverse outlet channel, that diminishing cross-section for exhausting flue products conversely presents an increasing cross-section for downdrafts, which diminishes their impact on the heater operation.

Heaters according to the subject invention and its embodiments thus work well under all kinds of wind conditions and in all kinds of environments. They always generate good, acceptable flue products.

In practice, the illustrated heater can also be used as an indoor appliance. In that case, the central outlet opening 23 may be provided with, or the transverse outlet channel structure 32 may be replaced by, a smoke or flue stack adaptor 81, and a smoke or flue stack 82 may be inserted through a closeable opening 83 in the top wall 25 or in top walls 25 and 36, as the case may be.

Figure 5B:
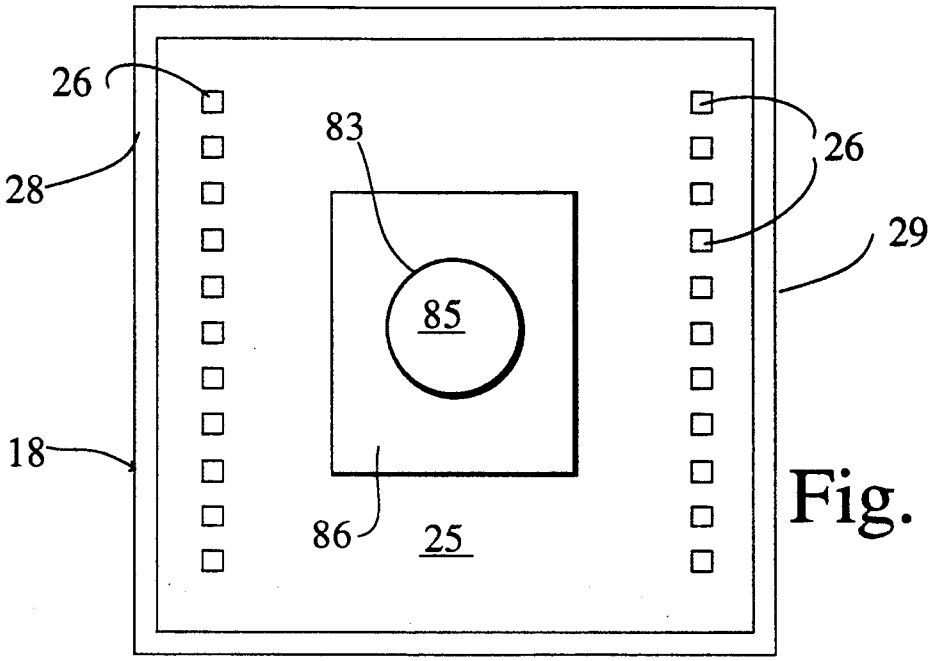
FIGS. 5*a* and 5*b* are views view similar to FIGS. 2*a* and 2*b* illustrating conversion of an outdoor heating appliance to an indoor heating appliance.
Figure 5A:
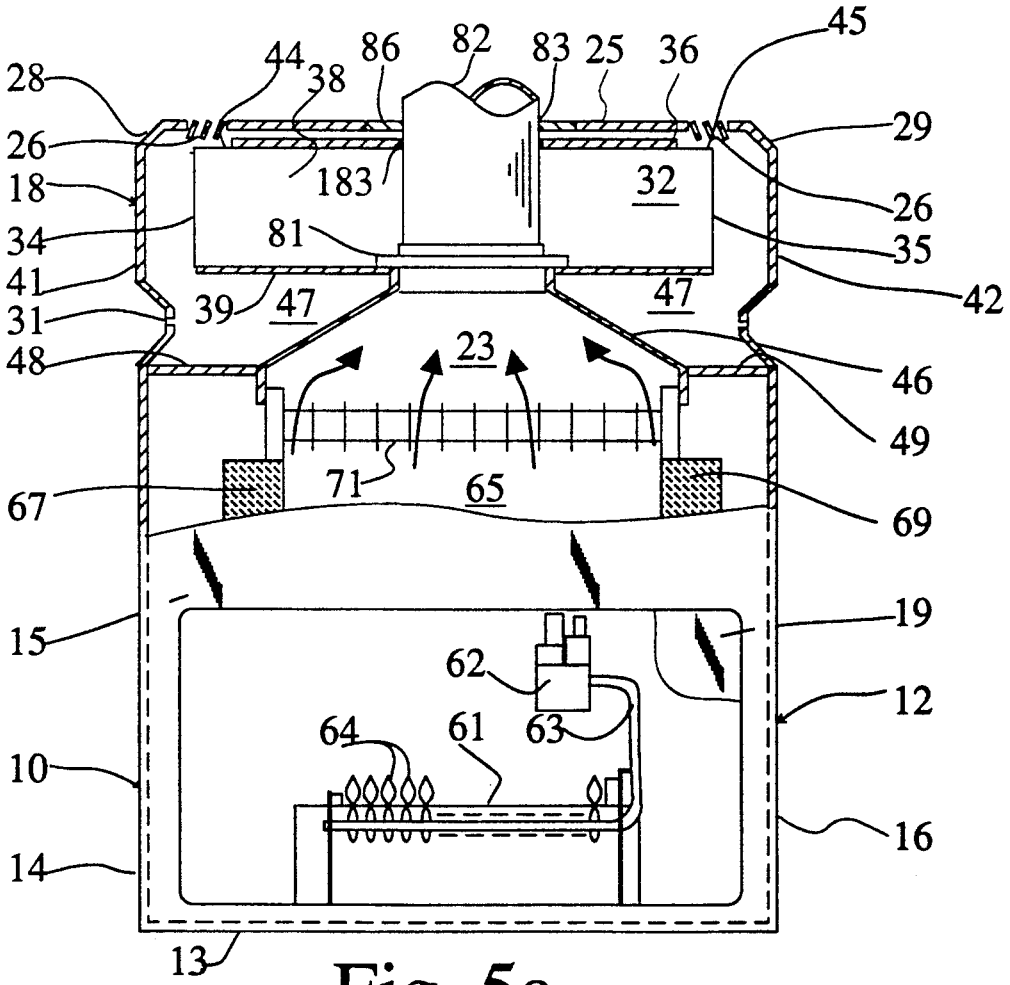

By way of example, the top wall 25 may be provided with a lid 85 that is closed as long as the heater is used as an outdoor heating appliance, as shown in FIGS. 1*a* to 4*b* and in the top view of FIG. 5*b*. When that lid 85 is removed, what is basically an outdoor heating appliance may be converted to, or used as, an indoor heating appliance with a flue stack 82 or, for that matter, may be used outdoors with a flue stack or chimney 82.

In particular, removal of the central lid 85 leaves the opening 83 having a diameter corresponding to the diameter of the flue stack 82. According to an embodiment of the invention illustrated in the top view of FIG. 5*b* the flue stack opening 83 and its lid 85 may be provided in a frame 86 that is substantially larger than the diameter of the flue stack 82 and opening 83 or lid 85 and that may be removably attached to the top wall 25.

In practice, the frame 86 may be removed for an insertion of the flue stack adaptor 81 through the top wall 25. The transverse channel structure 32 may be made removeable from the flue product collector 46 and may be removed therefrom prior to installation of the flue stack 82.

Alternatively, the top wall 36 of the transverse exhaust structure 32 may be provided with an insert (not shown) similar to the frame or insert 86 for providing a second flue stack opening 183 in registry with the opening 83 and the corresponding flue stack opening on the adaptor 81.

In either case, at least part of the transverse outlet channel structure 32 or of its top 36 is removed for accommodating the flue stack 82.

When the appliance is reconverted to outdoor use, a piece of sheet metal (not shown) may be used to close up the opening 183, in addition to the opening 83 as shown in the top view of FIG. 5*b* or as apparent from FIGS. 1*a* to 4*b* for that matter. In this or any other manner, the transverse outlet channel structure 32 is restored after removal of the flue stack 82.

A preferred baffle structure that may, for instance, be used in the heat exchanger 71, is shown in FIG. 6 with the aid of a few representative heat exchanger tubes 91, 191, 291 and 391 having heat dissipation fins 92, 192, 292 and 392 extending therearound, either coiled or in parallel circular plates or annuli.

FIG. 6 in particular shows a method of providing baffles, or shows a baffle structure, for an adjacent pair of elongate finned tubes 91 and 191 of a heat exchanger 71, wherein each of these tubes has an annular heat-exchange fin structure 92 or 192 thereabout.

A baffle 94 has or is provided with two elongate sections 95 and 96 extending at an obtuse angle to each other for accommodating, or so as to accommodate, one of the heat-exchange fin structures, such as the fin structure 92. That baffle 92 also has or is provided with a third elongate section 97 at an acute angle to one of the two elongate sections, such as the section 96, for accommodating, or so as to accommodate, both of the heat-exchange fin structures 92 and 192 at that acute angle.

The baffle 94 has utility by itself, but the full benefit thereof typically is attained in conjunction with other baffles.

In this respect, FIG. 6 shows a third elongate finned tube 291 having a third annular heat-exchange fin structure 292 thereabout adjacent a first one of the pair of elongate finned tubes 91 and 191, such as adjacent the second elongate finned tube 191 or the second fin structure 192.

A second baffle 194 has or is provided with fourth and fifth elongate sections 195 and 196 extending at an obtuse angle to each other for accommodating, or so as to accommodate, the third heat-exchange fin structure 292.

That second baffle 194 has or is provided with a sixth elongate section 197 extending at an acute angle to the fifth elongate section 196 for accommodating, or so as to accommodate, one of said pair of elongate finned tubes 91 and 191, such as the second elongate finned tube 191 or second fin structure 192, and the third annular heat exchange fin structure 292. The fifth elongate section 197 is spaced from the third elongate section 97, such as shown in FIG. 6.

A fourth elongate finned tube 391 having a fourth annular heat-exchange fin structure 392 thereabout is adjacent the third elongate finned tube 291 or adjacent the third fin structure 292. A third baffle 294 is provided with seventh and eighth elongate sections 295 and 296 at an obtuse angle for accommodating, or so as to accommodate, the third heat-exchange fin structure 292.

The third baffle has or is provided with a ninth elongate section 297 extending at an acute angle to the eighth elongate section 296 for accommodating, or so as to accommodate, the third and fourth annular heat exchange fin structures 292 and 392.

As seen in FIG. 6, the baffles 94, 194 and 294 extend with their acute apices in between, or into the gap between, adjacent finned tubes or fin structures. FIG. 6 shows the acute apices of baffles 94 and 194, for instance, resting against the fin structure 192.

Within the scope of the invention, each acute baffle apex may, however, be spaced equidistantly from the adjacent fin structures, such as from the fin structures 92 and 192 for the acute apex between sections 96 and 97 of the baffle 94.

The seventh elongate section 295 is spaced from the fourth elongate section 195, such as shown in FIG. 6. According to a preferred embodiment of the invention, that seventh elongate section 295 is spaced from that fourth elongate section 195 more than the sixth elongate section 197 is spaced from the third elongate section 97.

Preferably, the spacing between the obtuse fourth and seventh elongate sections 195 and 295 is some 1.4 to 1.6 times larger than the spacing between the acute third and sixth elongate sections 97 and 197.

The presently conceived best mode prefers the spacing between the vicinal obtuse sections to be one and one-half times the spacing between vicinal acute sections, for optimum fluid flow for the flue products, heating fluid or coolant 24.

As indicated in FIG. 6, the baffles according to embodiments of the invention cause the flue product or other heat-exchanging fluid 42 to flow optimally through the finned tube structure, including past the tubes 91-391 and their fin structures 92-392 in optimum heat-transfer relationship therewith.

Accordingly, the water or other heat-exchanged fluid 72 is optimally heated or cooled as the case may be. In this respect, the medium 24 could be a heating medium, as in the case of FIGS. 1 to 5, or a coolant, as in the case of a cooling or refrigerating unit. Conversely, the fluid 24 could be air or another fluid to be heated or cooled, while the fluid 72 could be a heated medium or coolant.

The subject extensive disclosure will render apparent or suggest to those skilled in the art various modifications and variations within the spirit and scope of the subject invention and equivalents thereof.

We claim:

1. In a method providing and operating an outdoor heating appliance wherein internal flames produce flue products inside a housing of said heating appliance, the improvement of rendering the operation of the heating appliance wind resistant, comprising in combination the steps of:

penetrating said housing with air inlet openings for sustaining combustion generating said flue products inside the heating appliance;

providing said housing with an outlet for said flue products;

providing said heating appliance above said outlet and said housing with a top structure having a top wall;

penetrating said top wall with exhaust openings for said flue products along opposite edges of said top structure;

providing said outlet between said housing and said top structure with a transverse outlet channel inside said top structure having opposite ends open at said exhaust openings adjacent said opposite edges of said top structure;

solidly enclosing said transverse outlet channel along its top, sides and bottom between said opposite ends except for said outlet between said housing and said top structure;

providing said top structure with solid wall portions between said exhaust openings and adjacent said opposite ends of said transverse outlet channel; and increasing the speed of flue products passing through said outlet from said housing to said transverse outlet channel.

2. A method as in claim 1, including:

recessing said top of the transverse outlet channel below said exhaust openings relative to said bottom of the transverse outlet channel at said opposite ends.

3. A method as in claim 1, including:

encompassing said outlet with a flue product collector depending from said transverse outlet channel into said housing and diminishing in cross-section to increase the speed of flue products passing through said flue product collector from said housing to said transverse outlet channel.

4. A method as in claim 3, including:

recessing said top of the transverse outlet channel below said exhaust openings relative to said bottom of the transverse outlet channel at said opposite ends.

5. A method as in claim 1, including:

substantially closing said housing around said bottom of the transverse outlet channel.

6. A method as in claim 5, including:

encompassing said outlet with a flue product collector depending from said transverse outlet channel into said housing and diminishing in cross-section to increase the speed of flue products passing through said flue product collector from said housing to said transverse outlet channel.

7. A method as in claim 1, including converting said heating appliance to an indoor appliance accommodating a flue stack, by:

providing said outlet with a flue stack adaptor;

providing said top wall of the top structure with an opening accommodating said flue stack; and removing at least part of the transverse outlet channel for accommodating said flue stack.

8. A method as in claim 7, including:

reconverting said heating appliance to an outdoor heating appliance by closing said opening and restoring said transverse outlet channel.

9. A method as in claim 1, wherein said heating appliance is provided with a heat exchanger having elongate finned tubes, each of said tubes having an annular heat-exchange fin structure thereabout:

providing baffles for said finned tubes;

providing each baffle with two elongate sections at an obtuse angle for accommodating one of said heat-exchange fin structures; and providing said baffle with a third elongate section at an acute angle to one of said two elongate sections for accommodating the heat-exchange fin structures of said one and of another one of said finned tubes at said acute angle.

10. In an outdoor heating appliance wherein internal flames produce flue products inside a housing of said heating appliance, the improvement of rendering the operation of the heating appliance wind resistant, comprising in combination:

inlet openings in said housing for air sustaining combustion generating said flue products inside the heating appliance;

a flue product outlet in said housing;

a heating appliance top structure having a top wall above said outlet and said housing;

exhaust openings for said flue products penetrating said top wall along opposite edges of said top structure;

a transverse outlet channel for said outlet between said housing and said top structure, said transverse outlet channel being inside said top structure and having opposite ends open at said exhaust openings adjacent said opposite edges of said top structure;

a flue product collector encompassing said outlet and depending from said transverse outlet channel into said housing and diminishing in cross-section from said housing to said transverse outlet channel;

said transverse outlet channel solidly enclosed along its top, sides and bottom between said opposite ends except for said flue product collector between said housing and said transverse outlet channel; and said top structure having solid wall portions between said exhaust openings and said outlet openings and adjacent said opposite ends of said transverse outlet channel.

11. A heating appliance as in claim 10, wherein:

said top of the transverse outlet channel has recesses below said exhaust openings relative to said bottom of the transverse outlet channel at said opposite ends.

12. A heating appliance as in claim 10, including:

a closure in said housing around said bottom of the transverse outlet channel.

13. A heating appliance as in claim 12, wherein:

said top of the transverse outlet channel has recesses below said exhaust openings relative to said bottom of the transverse outlet channel at said opposite ends.

14. A heating appliance as in claim 10, including:

means for converting said heating appliance to an indoor appliance accommodating a flue stack.

15. A heating appliance as in claim 10, including:

a heat exchanger in said housing having elongate finned tubes, each of said tubes having an annular heat-exchange fin structure thereabout;

baffles for said finned tubes;

each baffle having two elongate sections at an obtuse angle so as to accommodate one of said heat-exchange fin structures; and said baffle having a third elongate section at an acute angle to one of said two elongate sections so as to accommodate the heat-exchange fin structures of said one and of another one of said finned tubes at said acute angle.

* * * * *

UNITED STATES PATENT AND TRADEMARK OFFICE

CERTIFICATE OF CORRECTION

PATENT NO. : 5,158,069

DATED : October 27, 1992

INVENTOR(S) : Robert E. Hamos

It is certified that error appears in the above-indentified patent and that said Letters Patent is hereby corrected as shown below:

The drawing sheet, consisting of Figs. 6, should be added as shown on the attached page.

Signed and Sealed this

Third Day of December, 1996

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,158,069

DATED : October 27, 1992

INVENTOR(S) : Robert E. Hamos

It is certified that error appears in the above-identified patent and that said Letters Patent is hereby corrected as shown below:

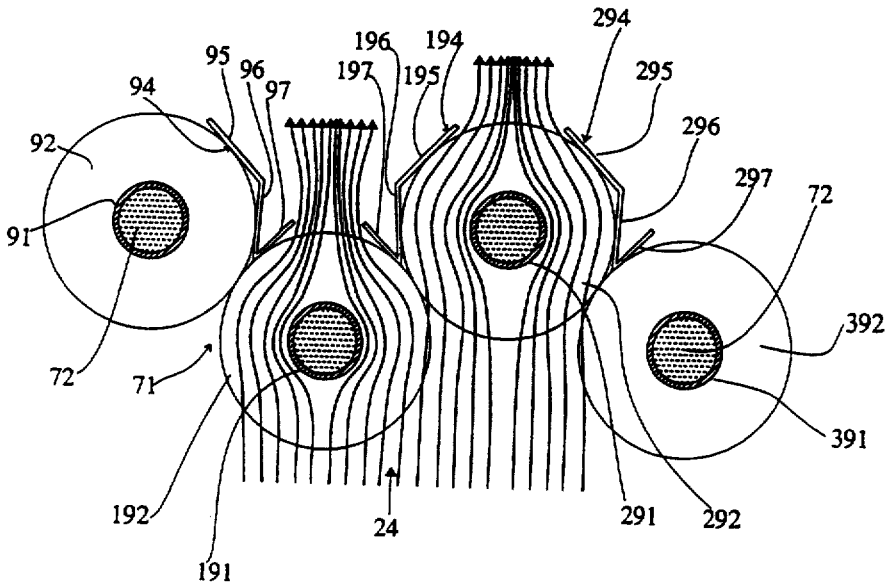

Fig. 6